US007337720B2

(12) United States Patent
Ross et al.

(10) Patent No.: US 7,337,720 B2
(45) Date of Patent: Mar. 4, 2008

(54) DOCTOR BLADE DESIGN FOR METERING INK TRANSFER TO ANILOX CELLS

(75) Inventors: Pascal Ross, Boucherville (CA); Mario Brunelle, Boucherville (CA); Joey Hanachian, Boucherville (CA)

(73) Assignee: F.L. Smithe of Canada, Inc., Duncansville, PA (US)

( * ) Notice: Subject to any disclaimer, the term of this patent is extended or adjusted under 35 U.S.C. 154(b) by 0 days.

(21) Appl. No.: 10/817,928

(22) Filed: Apr. 6, 2004

(65) Prior Publication Data

US 2004/0187718 A1 Sep. 30, 2004

Related U.S. Application Data

(63) Continuation of application No. 09/839,608, filed on Apr. 23, 2001, now abandoned.

(51) Int. Cl.
*B41F 31/02* (2006.01)

(52) U.S. Cl. ..... 101/366; 101/350.6; 101/363; 101/367

(58) Field of Classification Search ..... None
See application file for complete search history.

(56) References Cited

U.S. PATENT DOCUMENTS

| | | | | |
|---|---|---|---|---|
| 3,094,924 A | 6/1963 | Stark | ..... | 101/210 |
| 3,333,535 A | 8/1967 | Behringer | ..... | 101/157 |
| 3,561,360 A | 2/1971 | Branfield et al. | ..... | 101/350.1 |
| 4,432,282 A | 2/1984 | Jurinak | ..... | 101/350.5 |
| 4,497,250 A | 2/1985 | Dressler | ..... | 101/350.5 |
| 4,625,643 A | 12/1986 | Davis | ..... | 101/363 |
| 5,168,806 A | 12/1992 | Reder et al. | ..... | 101/366 |
| 5,213,037 A | 5/1993 | Leopardi, II | ..... | 101/363 |

(Continued)

OTHER PUBLICATIONS http://www.dpsflexo.com, Home page, Deneka Printingy System, Inc. (Oct. 22, 2001).

(Continued)

*Primary Examiner*—Jill E. Culler
(74) *Attorney, Agent, or Firm*—Price & Adams

(57) ABSTRACT

A dual-doctor blade assembly that can accurately meter ink delivery to the anilox cells on the anilox roll of a flexographic printing system. The system utilizes a retractable dual-blade configuration in conjunction with an ink chamber and a gap between the lower doctor blade and the anilox roll. The entire configuration can be adjusted for anilox rolls of various diameters. The upper blade in this system contacts the anilox roll at a point after its rotation through the application tray and scrapes ink from the surface of the anilox roll directly into the ink chamber. As the chamber fills with ink, the hydraulic pressure created by the spinning of the anilox roll increases to a point where the anilox cells are filled to the appropriate volume. The gap created between the lower doctor blade and the anilox roll serves two functions. As ink is drawn up on the anilox roll and in the anilox cells from the application tray, the gap allows ink to pass into the area of the anilox roll that is exposed to the ink chamber. The gap then also allows ink to be expelled from the chamber when a critical hydraulic pressure inside the chamber is reached. In this way, the application of the appropriate volume of ink into the cells is self-regulating, saving time and maintenance costs.

25 Claims, 5 Drawing Sheets

U.S. PATENT DOCUMENTS

| | | | | |
|---|---|---|---|---|
| 5,656,083 | A | 8/1997 | Schönberger | 118/107 |
| 5,791,248 | A * | 8/1998 | Atkins et al. | 101/350.6 |
| 5,826,509 | A | 10/1998 | Deneka | 101/366 |
| 5,988,064 | A | 11/1999 | Deneka | 101/366 |

OTHER PUBLICATIONS

International Search Report, International Application No. PCT/IB02/02987 (Oct. 24, 2002).

Publication No. 59062152, *Patent Abstracts of Japan* (Apr. 9, 1984).

* cited by examiner

DOCTOR BLADE DESIGN FOR METERING INK TRANSFER TO ANILOX CELLS

CROSS-REFERENCE TO RELATED APPLICATIONS

This is a continuation application of U.S. application Ser. No. 09/839,608, filed on Apr. 23, 2001 now abandoned.

FIELD OF THE INVENTION

The invention relates in general to a flexographic printing system and, in particular, to an apparatus and method to ensure proper metering of the volume of ink on the anilox cells of an anilox roll.

BACKGROUND OF THE INVENTION

Flexography is a unique printing process, developed primarily for printing packaging and other industrial materials. Packaging materials typically are supplied and processed in roll form, hence flexographic printing systems have developed using various configurations of rolls to feed these materials into the system. The materials on such rolls are often referred to in the art as a web or substrate. U.S. Pat. No. 4,878,427, the specification of which is incorporated herein by reference, describes various devices and mechanisms utilized in such systems. For example, one such system described therein is the simplest and most common form of the flexographic printing systems, consisting of four basic parts: doctor roll, anilox roll, plate cylinder, and impression cylinder. The mechanisms of this system are further described in this specification.

The ink used in flexographic systems has traditionally been thin, highly fluid, and rapid drying. The type of ink used on a particular job, however, may possess different properties. For example, when newer inks are requested or required for printing, they often contain greater pigmentation, and therefore have greater viscosity. The flexographic printing system does allow for more viscous or paste-type inks that are formulated from resins and may be either solvent or water reducible, but their use can affect the performance of the system.

Historically, the inking system of a flexographic printing group was often configured in the prior art using several rolls. As shown in U.S. Pat. No. 4,878,427, for example, these rolls were a doctor roll (sometimes called a rubber roll), an anilox roll, a printing cylinder, and an impression cylinder. The doctor roll, generally made of natural or synthetic rubber, is rotated through an ink reservoir and coated with ink. The doctor roll is configured to rotate against the anilox roll. The rotation and contact between the anilox and doctor rolls acts to transfer the ink from the doctor roll to the anilox roll. The anilox roll is usually made of metal or ceramic coating and is covered with anywhere from 80 to over 1200 tiny cells per lineal inch, called anilox cells. Ink is delivered into these cells by the considerable pressure created at the point of contact between the doctor roll and the anilox roll. The pressure created by the interaction of these rolls is important to meter the amount of ink delivered into the cells and ultimately to the printing cylinder. In this configuration, the pressure also eliminates excess ink from the surface of the anilox roll, leaving the ink primarily in the cells.

The printing cylinder sits between the anilox roll and the impression cylinder. The exterior of the printing cylinder is wrapped with the printing plate, which is often adhered to the cylinder using double-sided adhesive tape and holds the template of the design desired to be printed. The anilox roll rotates against the printing cylinder, coming into contact with the printing plate. This action causes the anilox roll to supply the desired amount of ink to the printing plate. Regulating this supply of ink is of particular importance. The web or substrate is fed into the system at the point where the printing plate contacts the impression cylinder. The ink from the printing plate is impressed onto the substrate as it rolls around the impression cylinder, which serves as a support. The contact pressure between the anilox roll and the printing cylinder is generally set as light as possible such that the material to be printed on is not over inked and the resulting image blurred. It follows that the metering of ink delivery into the anilox cells is very important to producing the desired resulting image. If too much ink permeates the cells, the plate is over-inked; too little ink will cause the plate to be too dry and no acceptable image will be made on the substrate, a situation known as ink starvation.

There have been variations on the basic flexographic printing system in the prior art. One such variation adds a "doctor blade" to the anilox roll just beyond the ink metering location where the doctor roll rotates against the anilox roll. Its purpose is to shave the surface of the anilox roll to remove surface ink and insure a more controlled delivery of ink to the printing plate. The doctor blade is often adjustable to allow more or less contact with the anilox roll and to compensate for variations in the roll's diameter. In the traditional four roll flexographic system, the doctor blade acts as an additional ink metering device in conjunction with the pressure between the doctor roll and the anilox roll. The pressure forces ink into the anilox cells and the doctor blade increases the accuracy of the ink delivery system to the printing plate.

Another variation eliminates the doctor roll altogether. As described in the '427 patent, an ink applicator pumps a heavy flow of ink to the anilox roll from a remote tank. A doctor blade is positioned just beyond the applicator. An ink reservoir pan serves as a catch basin below the anilox roll for funneling ink back to the remote ink tank.

Both of these systems present significant disadvantages. Yet another variation that has been tried utilizes an ink chamber that is set up beneath and in conjunction with the doctor blade. This system has a closed chamber that is filled with ink through an ink tube and pumped in from a remote ink tank. The pressure in the chamber may be adjusted to keep the anilox cells filled to the desired volume by adding or removing ink using the tube system.

As technology has evolved, ultra violet, solvent based, and stocked water based inks have become more popular. These inks have a higher viscosity than the standard water based ink. This poses difficulties for the three cylinder flexographic system because the higher viscosity of the inks makes it more difficult to fill the anilox cells to the desired volume. There is no pressure means in such a system which would force the thicker, more viscous inks to fill the anilox cells to the desired volume. As a result, less ink is impressed onto the printing plate than is needed and ink starvation often occurs. When the anilox roll is rotated through the ink applicator at certain speeds, the transfer of the ink from the application tray to the anilox cells becomes completely erratic. Moreover, the viscosity of the ink presents a great disadvantage to the system that employs a pump system. The tubes that feed the chamber from the remote ink tank become clogged with more viscous inks and require constant cleaning. Cleaning in this system is very difficult and required maintenance in excess over the cost of using it. The present invention eliminates this problem and the problem of ink starvation found in the prior art by providing an economic alternative to prior art systems.

OBJECTS OF THE INVENTION

The disclosed embodiment of the present invention consists of a dual-doctor blade assembly that can accurately meter ink delivery to the anilox cells on the anilox roll of a flexographic printing system. The system utilizes a retractable dual-blade configuration in conjunction with an ink chamber and a gap between the lower doctor blade and the anilox roll. The entire configuration can be adjusted for anilox rolls of various diameters. The upper blade in this system contacts the anilox roll at a point after its rotation through the application tray and scrapes ink from the surface of the anilox roll directly into the ink chamber. As the chamber fills with ink, the hydraulic pressure created by the spinning of the anilox roll increases to a point where the anilox cells are filled to the appropriate volume. The gap created between the lower doctor blade and the anilox roll serves two functions. As ink is drawn up on the anilox roll and in the anilox cells from the application tray, the gap allows ink to pass into the area of the anilox roll that is exposed to the ink chamber. The gap then also allows ink to be expelled from the chamber when a critical hydraulic pressure inside the chamber is reached. In this way, the application of the appropriate volume of ink into the cells is self-regulating, saving time and maintenance costs.

BRIEF DESCRIPTION OF THE DRAWINGS

The invention, together with further objects and advantages, may be best understood by reference to the following description taken in conjunction with the accompanying drawings, in the several Figures in which like reference numerals identify like elements, and in which.

DETAILED DESCRIPTION OF THE DRAWINGS

Figure 1:
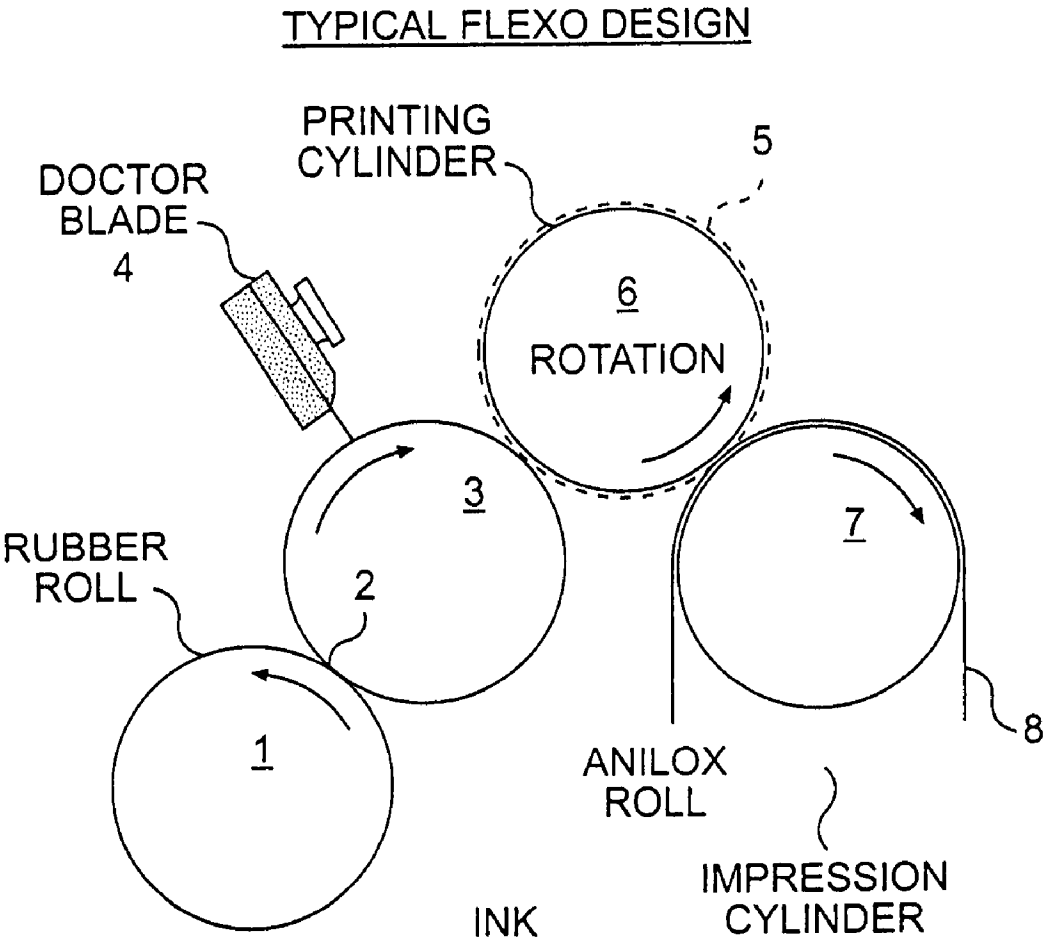
FIG. 1 (PRIOR ART)
FIG. 1 is a schematic depiction of a flexographic printing system utilizing four cylinders found in the prior art.

In the traditional flexographic design, shown in FIG. 1, the doctor roll 1 rotates through an ink reservoir or ink tray where it becomes coated with a thin film of printing ink or other coating material. The material is applied to the anilox roll 3 by the pressure created as the doctor roll 1 rotates against the anilox roll 3 at their point of contact 2. The anilox roll 3 is an engraved steel or ceramic roll which is used to meter the amount of ink delivered to the printing plate 5 via, for example, tiny dots or indentations on its surface, the anilox cells. The number of these cells per lineal inch and the volume of ink within each cell will determine the amount of ink delivered to the printing plate 5. The anilox roll 3 continues to rotate and the excess ink is removed by the scraping action of the doctor blade 4. There is a finely metered film of ink remaining on the anilox roll 3 and in the anilox cells after this point. This ink is transferred to the raised surface of the printing plate 5 held on the printing cylinder 6. The substrate or web 8 travels between the printing cylinder 6 and the impression roll 7. The impression roll 7 supports the web 8 as it contacts the printing plate 5 and picks up the precisely measured ink on the plate.

Figure 2:
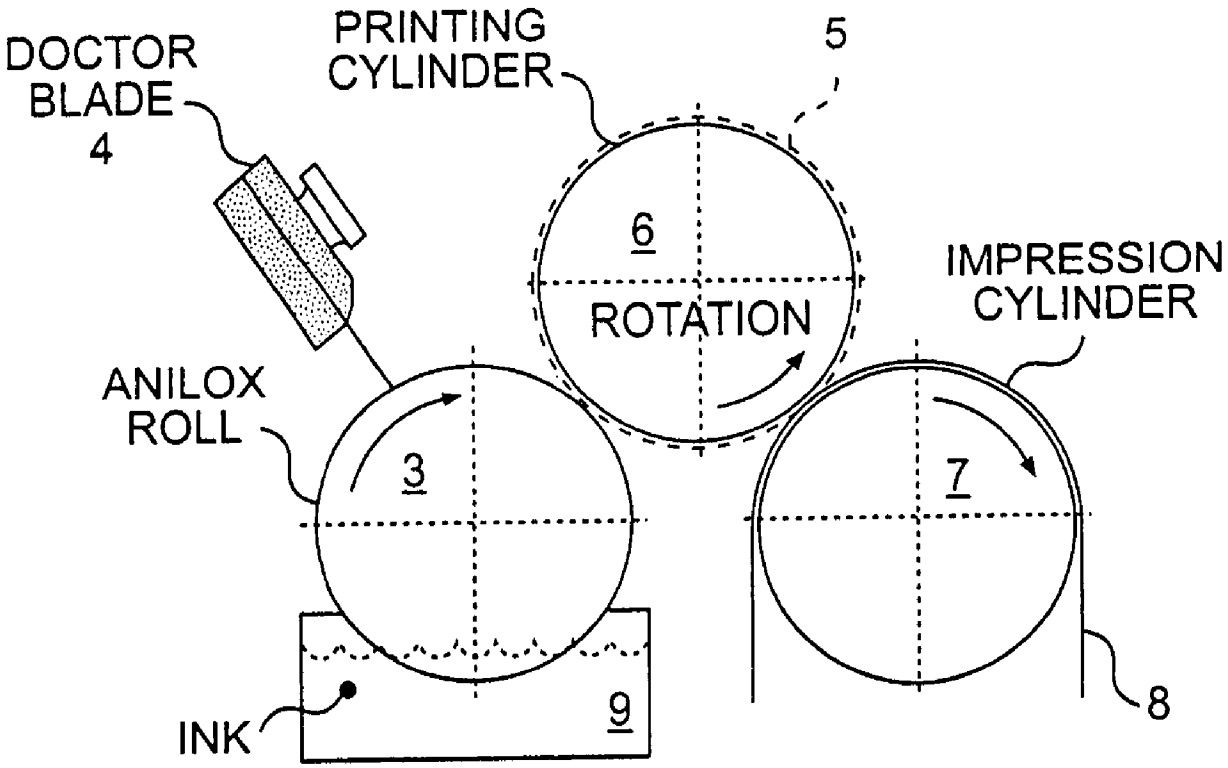
FIG. 2 (PRIOR ART)
FIG. 2 is a schematic depiction of a flexographic printing system utilizing three cylinders found in the prior art.

FIG. 2 shows a modification of FIG. 1 where the doctor roll has been eliminated from the configuration in favor of rotating the anilox roll 3 directly through an application tray or ink tray 9. As is known in the art, this system operates in essentially the same way as the traditional system, but eliminates the doctor roll. The anilox roll 3 is coated with ink from the ink tray 9, filling the anilox cells with printing ink. The anilox roll 3 rotates against the doctor blade 4 which removes excess ink from the surface of the anilox roll 3, leaving ink primarily in the anilox cells to be carried to the printing cylinder 6. The pressure between the anilox roll 3 and the printing cylinder 6 causes the ink to be transferred to the printing plate 5. The plate 5 contacts the web 8 as it travels between the impression cylinder 7 and the printing cylinder 6. The transfer of ink from the printing plate 5 to the web 8 creates the desired resulting image on the web.

As is known in the art, the pressure and alignment between the rolls is critical to the quality of the image created on the web or substrate. Generally, except for the pressure between the doctor roll and the anilox roll, the contact pressure between the rolls is kept extremely light and may be adjusted through mechanisms taught in the prior art. The pressure between the doctor roll and the anilox roll, however, is a different concern because of the need to utilize this pressure to cause an effective transfer of ink into the anilox cells.

The amount of ink in the anilox cells is of a particular concern. The ink on a specific printing project must be accurately metered to account for differences in the viscosity of the ink, the speed of rotation of the cylinders, and the type of substrate to be printed upon. The flexographic system in FIG. 1 accounts for this need by using the pressure between the doctor roll 1 and the anilox roll 3 to push ink into the anilox cells at a metered rate reflecting these variables. However, the configuration in FIG. 2 is inadequate to deal with the more viscous inks used commonly in flexographic systems today. While this arrangement is well suited for use with standard water based ink traditionally used in flexographic printing systems, the use of more viscous inks results in ink starvation.

Solutions to the problem of ink starvation would be to either revert back to using the tradition four-cylinder flexographic system, or use a pressurized ink chamber and tube system to supply the pressure needed to fill the anilox cells. Both of these options add to the cost of using and maintaining the flexographic system, and neither is as effective at metering the amount of ink injected into the anilox cells with respect to changes in viscosity, speed of rotation, and type of substrate.

Figure 3:
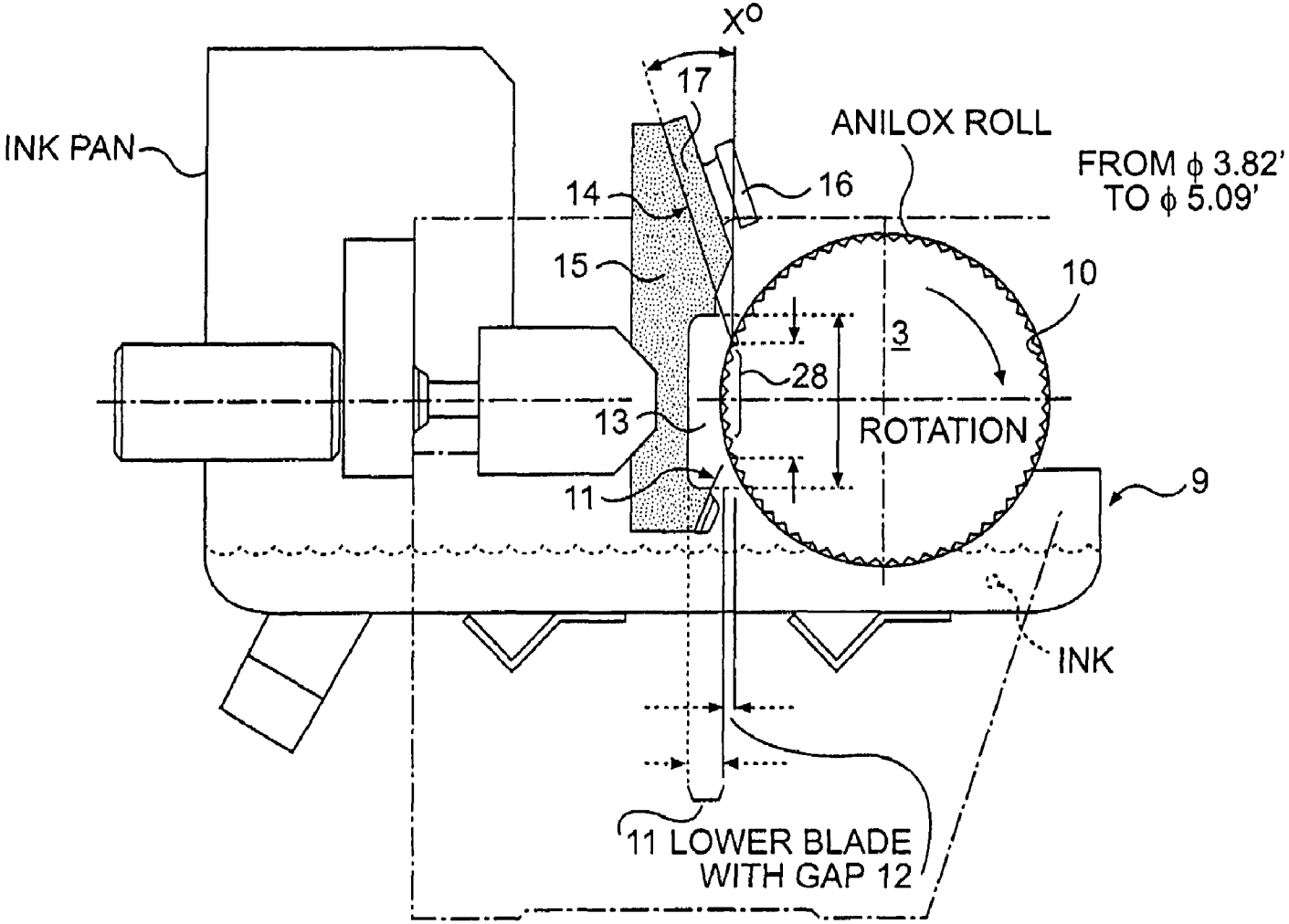
FIG. 3 is a side view of the doctor blade configuration and ink chamber utilized in the present invention.

FIG. 3 shows a detailed side view of one embodiment of the dual doctor blade system of the present invention. As in the prior art, the anilox roll 3 rotates through an ink pan or tray 9 where the anilox cells 10 are coated with a thin film of ink. In the example shown here, the anilox roll 3 may have a diameter between 3.82 inches and 5.09 inches, but the system may be modified and scaled to accommodate diameters of different sizes, as those skilled in the art will recognize. The anilox roll 3 rotates clockwise past the lower blade 11 where a gap 12 between the lower blade and the anilox roll allows ink into the ink chamber 13. The upper blade 14 is supported on an assembly mount 15 and is held firmly in place by a series of knobs 16 which, when tightened, press the support block 17 more firmly against the upper blade 14, squeezing it between the mount 15 and the block 17. In this way, the blade can be held stiffly at an angle x degrees measured against the vertical axis, although best performance occurs when this angle is between 19 and 30 degrees. Upper blades of varying blade widths may be inserted between the support block 17 and the assembly mount 15, but generally range in size between ¾ and ⅞ inch wide for best results. In this context, the term "blade width" refers to the dimension that is perpendicular to both the axis of rotation and the length of the anilox roll.

The lower blade 11 is attached at the opposite end of the mount 15. In this embodiment, it forms an angle with the vertical that mirrors the angle formed by the upper blade, however the angle of the lower blade may vary widely and still produce optimal results. The lower blade 11 does not contact the anilox roll 3. Rather it is set such that there is a gap 12 between the blade and the anilox roll. This gap 12 serves both the function of allowing ink to enter the ink chamber 13 and expelling ink from the chamber when a critical pressure is reached. In one embodiment, this gap is 0.090 inches, however gaps of different sizes are possible for other embodiments of the invention. Ideally, the gap will vary in size from 1/50 inch to ⅛ inch, depending on the width of the upper blade 14.

The ink chamber 13 in one embodiment has a height of 1½ inches and a depth of 19/64 inches. The length of the chamber 13 is equal to the length of the anilox roll 3 but, like its other dimensions, varies with the size and scale of the embodiment of the invention. Typically, an anilox roll may be between 10 and 32 inches wide, but the ink chamber is capable of accommodating all desired widths. The height and depth of the chamber 13 is proportional to the diameter of the anilox roll 3 used in the printing process, but a smaller volume chamber is preferred because it fills to the critical volume faster and facilitates printing time.

In one embodiment, an arc of 31/32 inch of the anilox roll 3 is exposed to the ink chamber 13. The length of the arc 28 exposed to the pressure inside the chamber 13 determines the accuracy of the volume at which the anilox cells 10 are filled. Hence, the more time a cell is exposed to the inside of the chamber, the more likely it is to be filled to its maximum capacity. In this way, the chamber 13 is a mechanism that insures ink permeates the anilox cells 10 to the desired volume.

Figure 4:
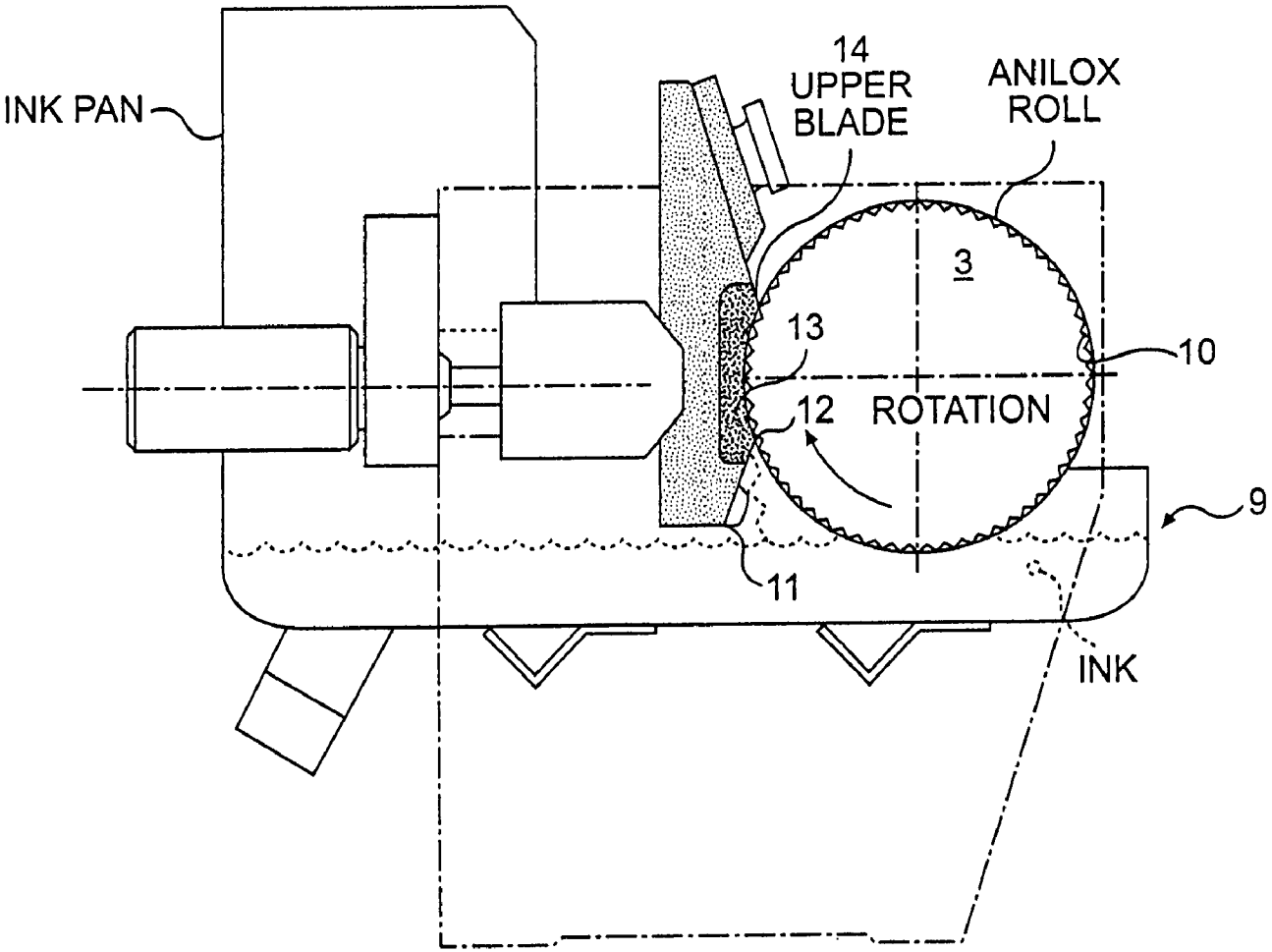
FIG. 4 is an alternate view of FIG. 3 with a filled ink chamber demonstrating the situation when critical hydraulic pressure is reached in the chamber.

FIG. 4 shows the doctor blade assembly when the hydraulic pressure in the ink chamber 13 has reached a critical point. As the flexographic system is started, the chamber 13 is empty. Generally, as the anilox roll 3 rotates through the ink tray 9, it becomes coated with ink and the anilox cells 10 have a minimum volume of ink that they carry with them. This ink is carried through the gap 12 until the anilox roll 3 contacts the upper blade 14, which can be adjusted to provide the proper pressure on the anilox roll 3, in a manner known by those of ordinary skill in the art. As the upper blade 14 shaves off excess ink from the surface of the anilox roll 3, that ink is captured in the ink chamber 13 leaving only the maximum volume of ink allowed in the anilox cells 10 to be transferred onto the printing plate. As the amount of ink in the chamber 13 increases, so does the hydraulic pressure within the chamber. This pressure creates a hydraulic effect, forcing the ink from the chamber 13 into the cells 10 and out of the gap 12 created by the lower blade 11, allowing excess ink to be expelled from the chamber automatically. As the pressure within the chamber 13 increases, ink will be expelled through the gap 12 at an increasing rate. Eventually, however, the pressure within the chamber 13 will reach an equilibrium, thereby maintaining a pressure to force ink into the cells 10 without the use of costly pumping or hosing equipment that need to be continuously cleaned.

Figure 5:
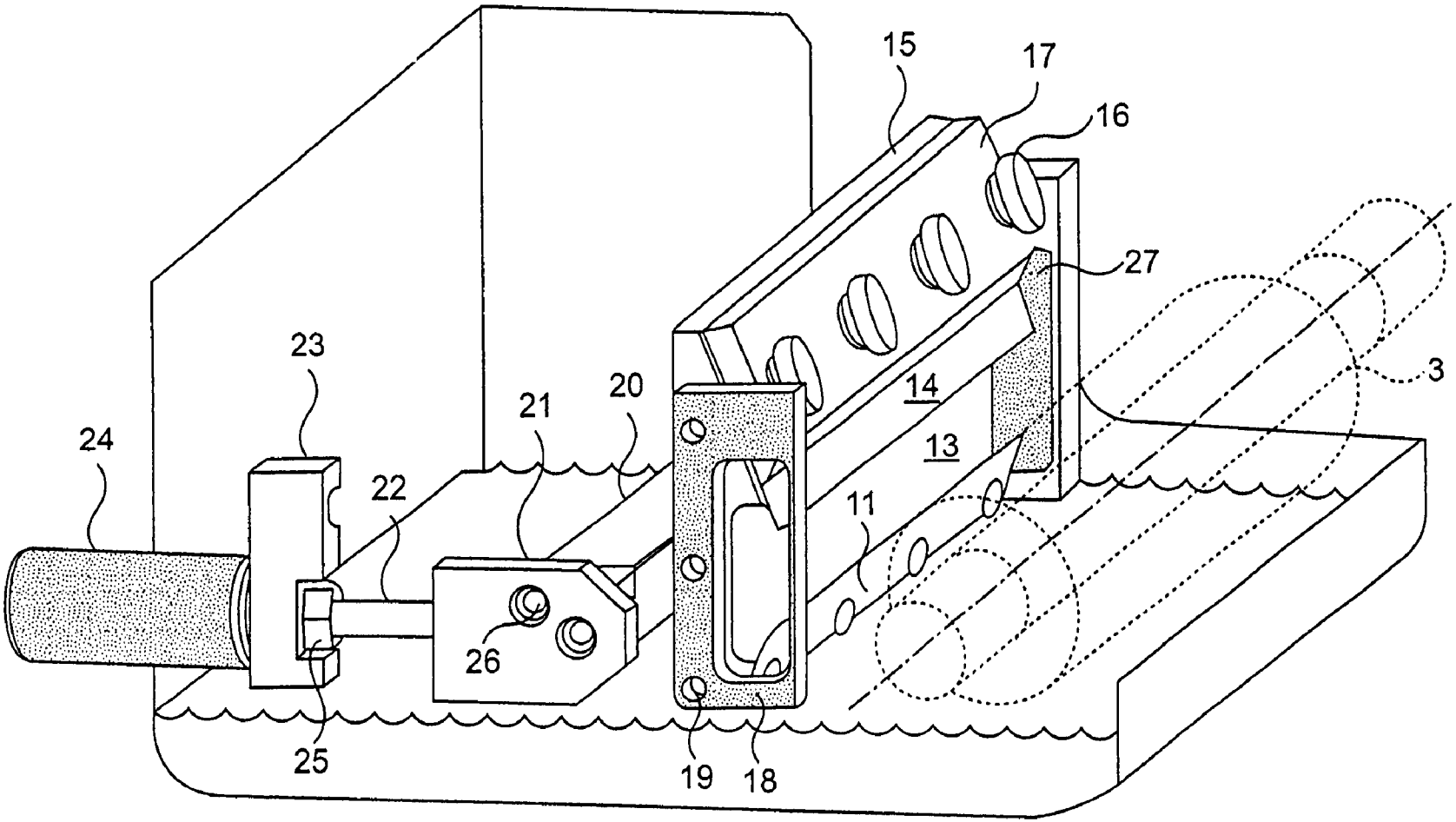
FIG. 5 is a perspective view of the doctor blade system, the ink chamber, and the adjusting mechanism described in the present invention.

FIG. 5 is a perspective illustration of an example of a mechanism for adjusting the doctor blade assembly. In this embodiment, the mount 15 for the assembly is held to a seal 27 inside of a seal frame 18 by three screws 19 on each side. The seal 27 functions to insure the integrity of the pressure inside the ink chamber 13. The upper blade 14 is held in between the seal frame 18. Four knobs 16 also hold the upper blade 14 in between the mount 15 and the support block 17 to insure correct positioning of the upper blade for the appropriate amount of contact with the anilox roll 3. The knobs 16 also allow for the insertion of blades that vary in blade width. The width of the lower gap will depend on the width of the upper blade selected.

Attached to the back of the mount 15 is a cross bar 20 that holds the entire doctor blade assembly. The cross bar 20 is attached to a carrier block 21 by a pair of screws 26 on each side. The carrier block 21 has a threaded rod 22 attached which is held to the holding block 23 by a nut 25. The holding block 23 maintains the adjusting knob 24. Each side of the block 23 has thrust bearing to make sure the knob 24 turns freely. The adjusting knob 24 is used to move the entire doctor blade assembly forward or backwards as needed to compensate for varying diameters of the anilox roll 3 and to ensure proper alignment of the upper blade 14 with the anilox roll.

The invention is not limited to the particular details of the apparatus depicted here. Certain changes may be made in the above described apparatus without departing from the true spirit and scope of the invention herein involved. It is intended, therefore, that the subject matter in the above depiction shall be interpreted as illustrative and not in the limiting sense.

What is claimed is:

1. A doctor blade assembly for use in a flexographic printing system comprising:

an ink tray, an anilox roll, an assembly mount positioned in spaced relation adjacent to said anilox roll and above said ink tray, an upper doctor blade extending from said assembly mount into contact with said anilox roll, a lower doctor blade extending from said assembly mount to a position spaced from said anilox roll to form a gap between said lower doctor blade and said anilox roll, said anilox roll, said assembly mount, said upper doctor blade, and said lower doctor blade forming a chamber to receive a flow of ink into and out of said ink tray through said gap, said anilox roll being rotatable through said ink tray to receive a coating of ink on the surface of said anilox roll and direct flow of ink through said gap into said chamber, said upper doctor blade scraping excess ink from said anilox roll into said chamber until the hydraulic pressure in said chamber reaches a predetermined pressure and excess ink is expelled from said chamber through said gap into said ink tray.

2. A doctor blade assembly as set forth in claim 1 which includes:

said upper doctor blade being adjustable to provide sufficient contact for varying diameters of said anilox roll.

3. A doctor blade assembly as set forth in claim 1 which includes:

said upper doctor blade being positioned at an angle ranging from 19 degrees to 30 degrees from the vertical axis.

4. A doctor blade assembly as set forth in claim 1 which includes:

said upper doctor blade contacting said anilox roll for the entire width of said anilox roll.

5. A doctor blade assembly as set forth in claim 1 which includes:

said lower doctor blade being positioned to mirror the angle of said upper doctor blade with the vertical axis.

6. A doctor blade assembly as set forth in claim 1 which includes:

said chamber being about 10 to about 32 inches in width, about 1½ to about 4½ inches in height, and about 19/64 to about 57/64 inch in depth, and said gap having a width exceeding 1/50 inch.

7. A doctor blade assembly as set forth in claim 6 in which:

said upper blade is about ½ to about 1 inch in blade width.

8. A doctor blade assembly as set forth in claim 7 in which:

said gap is about 0.020 to about 0.125 inch in width.

9. A doctor blade assembly as set forth in claim 1 which includes:

said gap having a preselected width exceeding to maintain an equilibrium in said chamber.

10. A system comprising:

an ink tray, an anilox roll rotating through said ink tray and receiving a coating of ink, an assembly mount positioned in spaced relation adjacent to said anilox roll and above said ink tray, a chamber formed between said anilox roll and said assembly mount, means for allowing ink from said anilox roll to enter said chamber, means for scraping ink from said anilox roll and capturing the ink in said chamber, and means for expelling ink from said chamber after the hydraulic pressure in said chamber reaches a predetermined pressure.

11. A system as set forth in claim 10 which includes:

said means for allowing ink from said anilox roll to enter said chamber including means for expelling ink from said chamber after the hydraulic pressure in said chamber reaches a predetermined pressure.

12. A system as set forth in claim 11 in which:

said anilox roll, said assembly mount, said means for scraping ink from said anilox roll and capturing the ink in said chamber, and said means for allowing ink from said anilox roll to enter said chamber form said chamber.

13. A system as set forth in claim 10 which includes:

means for maintaining consistent hydraulic pressure within said chamber.

14. A system as set forth in claim 13 which includes:

said means for allowing ink from said anilox roll to enter said chamber including means for expelling ink from said chamber after the hydraulic pressure in said chamber reaches a predetermined pressure and means for maintaining a consistent hydraulic pressure within said chamber.

15. A system as set forth in claim 10 which includes:

said assembly mount being adjustable to accommodate varying diameters of said anilox roll.

16. A system as set forth in claim 10 which includes:

said means for scraping ink from said anilox roll and capturing the ink in said chamber being positioned at an angle ranging from 19 degrees to 30 degrees from the vertical axis.

17. A system as set forth in claim 16 which includes:

said means for scraping ink from said anilox roll and capturing the ink in said chamber being in contact with said anilox roll for the entire width of said anilox roll.

18. A system as set forth in claim 16 which includes:

said means for allowing ink from said anilox roll to enter said chamber including means for expelling ink from said chamber after the hydraulic pressure in said chamber reaches a predetermined pressure.

19. A system as set forth in claim 18 which includes:

said means for allowing ink from said anilox roll to enter said chamber being positioned to mirror the angle of means for scraping ink from said anilox roll and capturing the ink in said chamber being in contact with said anilox roll for the entire circumference of said anilox roll with respect to the vertical axis.

20. A method of metering the transfer of ink into anilox cells comprising the steps of:

rotating an anilox roll through an ink reservoir to receive a coating of ink, rotating the anilox roll past a gap in a chamber to allow the ink to flow through the gap and enter the chamber, scraping excess ink from the anilox roll to capture the ink in the chamber, and expelling ink from the chamber through the gap after the chamber reaches a predetermined hydraulic pressure.

21. A method as set forth in claim 20 which includes:

maintaining an equilibrium pressure in the chamber.

22. A method as set forth in claim 20 which includes:

forcing ink from the chamber into a plurality of cells on the anilox roll.

23. A method as set forth in claim 20 which includes:

coating the anilox roll with ink.

24. A method as set forth in claim 20 which includes:

reusing ink in the chamber to coat the anilox roll.

25. A method as set forth in claim 20 which includes:

sealing the chamber to insure the pressure therein.

* * * * *